United States Patent [19]

Gebhardt

[11] Patent Number: 4,604,506

[45] Date of Patent: Aug. 5, 1986

[54] SELF-ADJUSTING SWITCH MECHANISM

[75] Inventor: Wallace E. Gebhardt, Logansport, Ind.

[73] Assignee: Switches, Inc., Logansport, Ind.

[21] Appl. No.: 753,446

[22] Filed: Jul. 10, 1985

[51] Int. Cl.[4] ..... H01H 3/14; H01H 21/36

[52] U.S. Cl. ..... 200/61.89; 200/11 G; 200/11 K

[58] Field of Search ..... 200/11 G, 11 J, 11 TW, 200/11 K, 16 C, 16 D, 61.88, 61.89, 61.9, 61.91

[56] References Cited

U.S. PATENT DOCUMENTS 3,939,313 2/1976 Hayashi et al. ..... 200/61.89 X

*Primary Examiner*—J. R. Scott

*Attorney, Agent, or Firm*—Hill, Van Santen, Steadman & Simpson

[57] ABSTRACT

The present invention is directed to a switching mechanism particularly intended for use in connection with a braking system of a vehicle. The switching mechanism includes a switch supported in a housing and having a movable element which cooperates with an actuating system coupled to the brake pedal. The switch is contained in a housing which is arranged to frictionally engage a brake pedal arm pivot yoke. The switch actuator arm is arranged to be coupled to the brake pedal arm on the vehicle. A friction clutch is provided between the switch actuator arm and the switch actuator to permit a driving but slippable connection between the two whereby the switch actuator arm can pivot to a greater angular extent than the switch actuator. Thus, the switch mechanism of the present invention is self-adjusting despite variations resulting from manufacturing and age variations in the brake pedal assembly.

10 Claims, 8 Drawing Figures

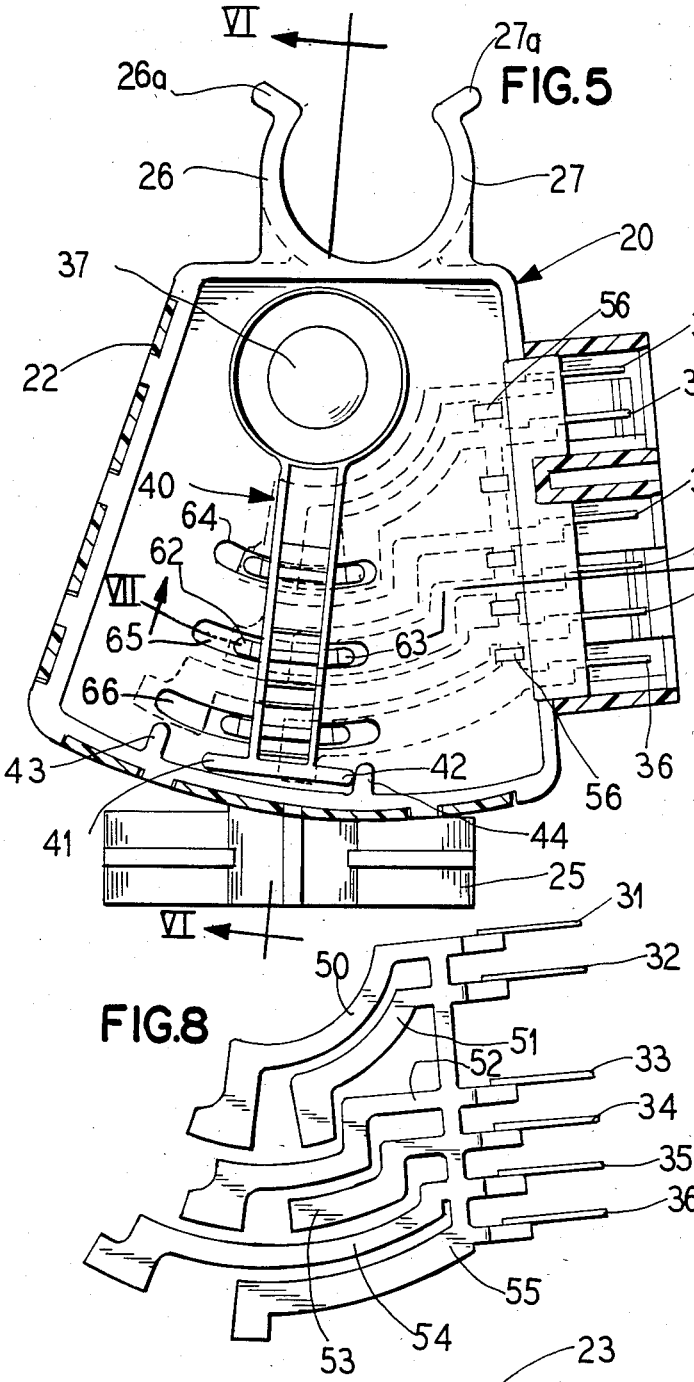
FIG.5
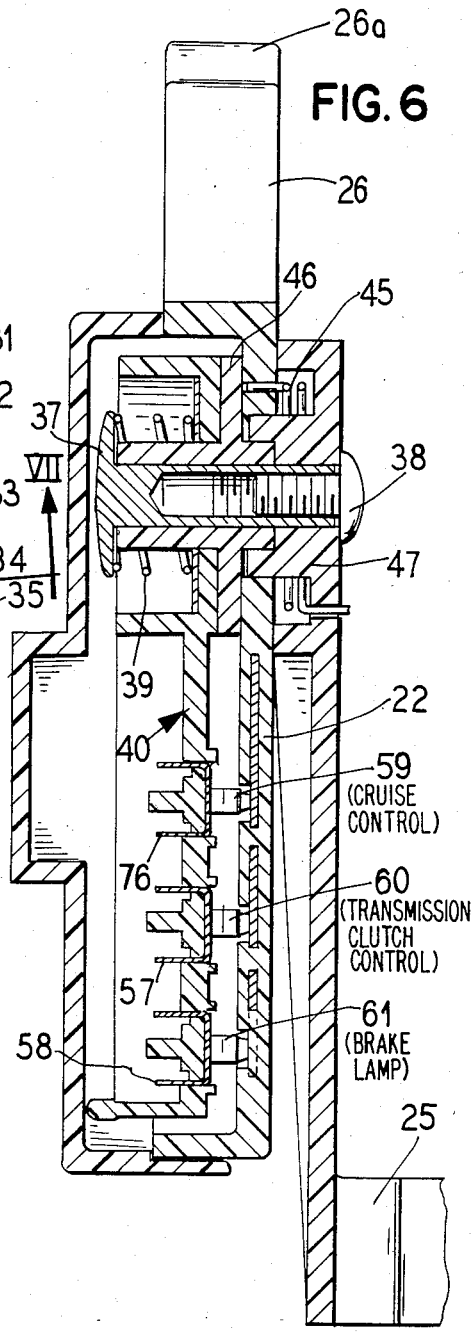
FIG. 6
FIG.8
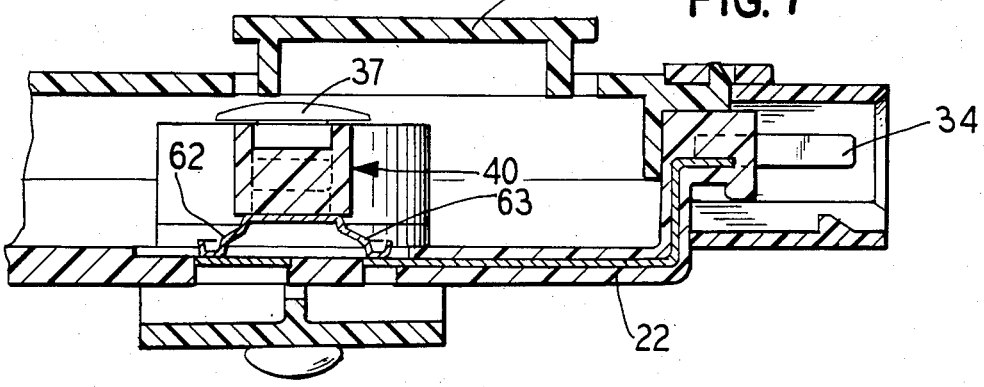
FIG. 7

SELF-ADJUSTING SWITCH MECHANISM

BACKGROUND OF THE INVENTION

1. Field of the Invention

The present invention is in the field of switch assemblies for a vehicle braking system and, in particular, one having a switch actuator arm and a switch actuator disposed in a housing, with an interconnection between the two which provides for joint movement of the two for a limited extent, and then permits relative movement between the switch actuator arm and the switch actuator after the switching function has been accomplished.

2. Description of the Prior Art

The switch which operates the brake lights on most vehicles is located behind and away from the brake pedal arm. The mechanism is actuated when the brake pedal is depressed to a point where the arm meets and depresses a plunger which actuates the switch mechanism. The mechanism itself has to be manually adjusted in both the installation in a vehicle and as wear occurs in the system during the lifetime of the vehicle.

There is some subject matter in common between the present invention and the assignee's U.S. Pat. No. 3,670,119, issued June 13, 1972.

SUMMARY OF THE INVENTION

The present invention provides a brake switch mechanism which automatically readjusts its limits due to variable conditions presented to the operator of the vehicle.

In one specific embodiment of the invention, there is provided a friction clutch between the switch-actuating arm and the switch actuator which permits the two to rotate in unison for a relatively small arc and, when the switch actuator is mechanically restrained from further movement, permits the switch-actuator arm to continue for a substantially larger arcuate travel.

The brake switch mechanism thus includes a free or lost motion connection between the actuator arm and the actuator to accommodate relative movement after the switch-carrying actuator has been moved to its switch-closing position. This feature allows for the actuator arm to be deflected an amount greater than necessary for closing of the actuator, and returning to a stable position between a maximum and normal deflected position to accommodate increases and decreases in travel of the brake pedal arm.

A further feature of the present invention is an automatic readjustment which allows for installation variations in the assembly of the vehicle, and changes due to use. The brake switch mechanism is self readjusted each time the actuator is deflected an amount greater than necessary to close the switch.

The switch of the present invention can be used in conjunction with a cruise control switch which allows deenergization of the cruise control system when the brake is applied, and a transmission clutch control switch which becomes operative when the switch is utilized with the clutch pedal mechanism.

Specifically, the improved switch assembly of the present invention employs a housing, with means thereon which are arranged to frictionally engage a brake pedal arm pivot yoke on the vehicle. Means are provided to restrain pivotal movement of the housing about the yoke. A switch-actuator arm is arranged to be coupled to the brake pedal arm on the vehicle. The switch actuator arm cooperates with a switch actuator which is disposed in the housing. A friction clutch means is interposed between the switch-actuator arm and the switch actuator to permit a driving but slippable connection between the two whereby the switch-actuator arm can pivot to a greater angular extent than the switch actuator. Electrical switch contacts are carried by the actuator to cooperate with circuit means engageable therewith and make electrical continuity therebetween. Means are also provided in the housing for limiting the pivotal movement of the electrical contacts to a predetermined arc. Terminals connected to the circuit means are provided which extend outside the housing for connection to the electrical system of the vehicle.

In a preferred form of the invention, the circuit means is integrally molded within a wall of the housing. The switch assembly may also include spaced abutment means in the housing to limit the travel of the switch actuator within the housing, with a spring means being provided to bias the actuator toward the first of the abutment means.

The friction clutch, in a preferred form of the invention, takes the form of a low-friction disk which is coupled to the switch actuator arm, the disk bearing against the actuator within the housing. Spring means are provided which urge the disk and the actuator together with a controlled amount of compressive force by permitting relative movement between the two when the switch actuator abuts the second of the abutment means.

The switch assembly may include arcuate slots formed in the housing and exposing the circuit means to engagement by the electrical contacts carried by the actuator. Preferably, the electrical contacts are composed of a spring metal in the form of a bridge, the ends of the contacts engaging the circuit molded within the housing. This circuit means may consist of flat strips which are embedded in the housing by means of an injection molding process.

BRIEF DESCRIPTION OF THE DRAWINGS

The present invention will be described more completely in conjunction with the attached drawings in which:

FIG. 5 is a cross-sectional view illustrating the interior of the switch housing;

FIG. 6 is a cross-sectional view taken substantially along the line VI—VI of FIG. 5;

FIG. 7 is a fragmentary cross-sectional view taken substantially along the line VII—VII of FIG. 5; and FIG. 8 is a plan view of a wiring pattern which can be used in conjunction with the switch of the present invention.

DESCRIPTION OF THE PREFERRED EMBODIMENTS

Figure 2:
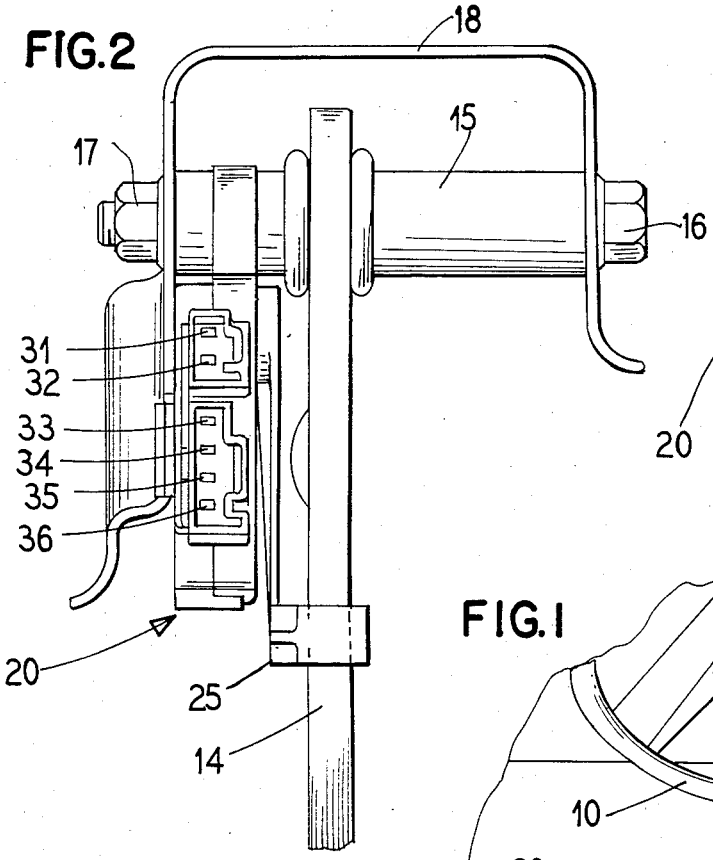
FIG. 2 is a side elevational view of a brake pedal arm and mounting assembly showing how the improved switch of the present invention is mounted.
Figure 1:
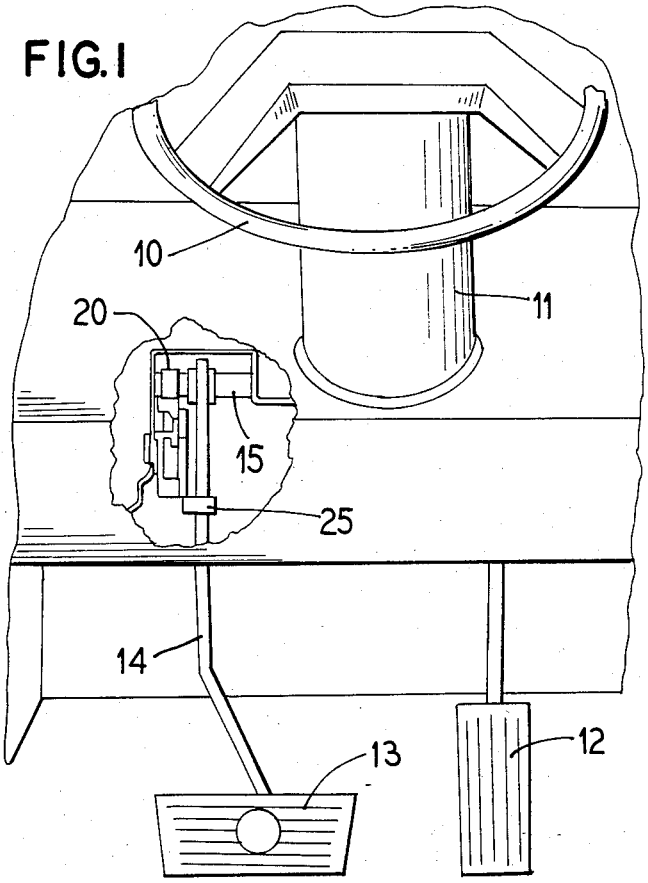
FIG. 1 is a fragmentary view with portions broken away showing the location of the improved switch of the present invention in an automobile.
Figure 3:
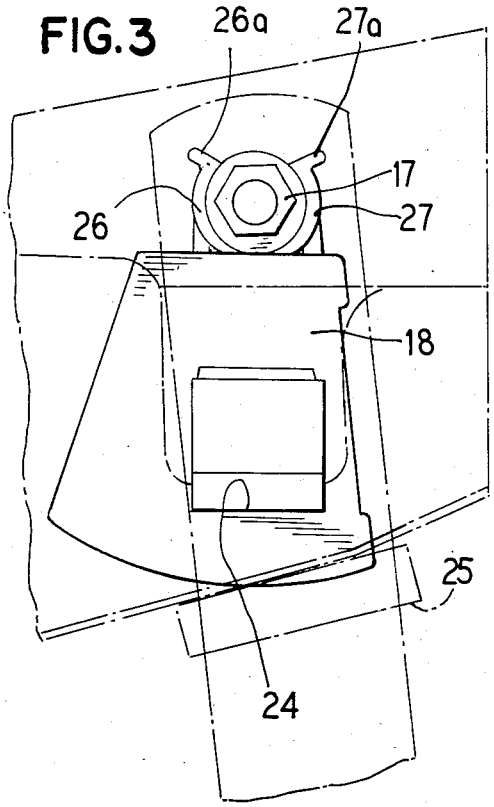
FIG. 3 is a side elevational view taken 90° from the showing of FIG. 2.

FIG. 1 illustrates somewhat schematically the positioning of the improved switch assembly of the present invention in the interior of a vehicle which includes a steering wheel 10 mounted on a steering column 11. An accelerator pedal 12 and a brake pedal 13 are provided in the conventional way. The brake pedal 13 is connected to a brake pedal arm 14 which, as best seen in FIG. 2, actuates a brake pedal arm pivot yoke 15. The latter is supported on a mounting stud 16 having a threaded end portion on which a nut 17 is received. A brake pedal mounting bracket 18 is suitably apertured so that the stud 16 passes therethrough and is held in rigid relation.

Figure 4:
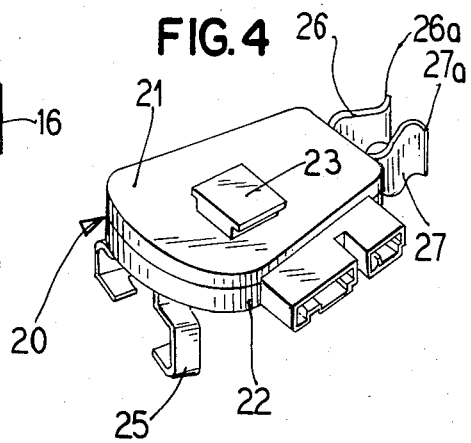
FIG. 4 is a view in perspective of the switch housing and particularly illustrating the mounting means for connecting the housing to a brake pedal mounting bracket.

The improved switch assembly of the present invention has been denoted by reference numeral 20. As seen in FIG. 4, the switch assembly 20 consists of a housing composed of two interengaging portions 21 and 22 composed of a suitable electrically non-conductive plastic material. On one side, the housing portion 21, has an integral projection 23 extending therefrom and arranged to be press fit in an opening 24 on the brake pedal mounting bracket 18. This connection serves to prevent pivotal movement of the housing relative to the brake pedal arm.

On the opposite end of the housing, there is flexible, C-shaped clamping means of switch actuating arm 25 which is received about the brake pedal arm as shown in FIG. 2, to actuate the switching mechanism in a manner which will subsequently be explained.

Finally, the housing in its lower portion 22 carries a pair of flexible, partially circular segments 26 and 27 which snap around the brake pedal arm pivot yoke 15 as illustrated in FIG. 2. Tabs 26*a* and 27*a* are provided at the end portions of the segments 26 and 27 to faciliate engaging and disengaging the switch assembly from the yoke 15.

Extending through the housing are pairs of electrical terminals. In the particular embodiment of the invention shown, there are three pairs of terminals provided but it is clear that lesser or greater numbers can also be used in accordance with the present invention. An upper pair of terminals 31 and 32 are part of the circuit for the cruise control switch. When actuated, this switch allows the cruise control to be disconnected when the brake is applied.

Intermediate terminals 33 and 34 are part of the electrical system for the transmission clutch control. Most modern automatic transmissions have a provision for locking up the torque converter by means of a hydraulically actuated clutch mechanism. The hydraulic system is, in turn, controlled by a solenoid which is usually turned on and off by a logic device. The contacts 33 and 34 are connected between the solenoid and the logic device (not shown) and provide the feature of automatically unlocking the torque converter when the brakes are applied, regardless of the logic device signal. This allows the vehicle to respond smoothly to the brakes without the jerking action that would be present with a locked-up torque converter.

Finally, the terminals 35 and 36 are part of a normally open switch which controls the energization of the lamp bulbs in the brake lights.

As best seen in FIG. 5, the interior of the housing is provided with a headed hollow pin 37 into whose hollow end there is threaded a bolt 38. The headed end of the pin 37 serves to bottom a pressure biasing spring 39 which serves as the pivotal axis for a switch actuator generally indicated at reference numeral 40. The switch actuator 40 may be generally U-shaped in cross section and has laterally extending lugs 41 and 42 at its lower end as shown in FIG. 5. These lugs are arranged to cooperate with a pair of spaced abutment means consisting of a first abutment 44 and a second abutment 43 forming part of the housing section 22. A torsion spring 45 (a fail safe portion of the switch) serves to bias the actuator 40 against the second abutment 43, thus energizing the brake lamp bulbs, warning the operator if a malfunction occurs.

The actuator 40 cooperates with a disk-shaped portion 46 of relatively low friction material such as nylon or the like. The disk portion 46 is keyed or otherwise connected to an enlarged portion 47 of the switch actuator 40.

As best illustrated in FIGS. 6 and 7, the wall of the housing portion 22 has embedded in it spaced flat strips of electrically conductive material best illustrated in FIG. 8 at reference numerals 50 through 55, inclusive. As illustrated in FIG. 5 and FIG. 8, the electrical circuit board consists of a flat pattern of flat strips interconnected together for mechanical strength. A pattern such as that shown in FIG. 8 is suspended in an injection mold and then the body of the housing is injection molded around it. Following the embedment of the metallic conductors in the non-conductive plastic, a series of holes 56 (FIG. 5) is punched through the housing to break the portions of the metal strips connecting the various strips and thereby isolate each of the strips from the others electrically.

The actuator 40 carries a plurality of contact carriers 76, 57 and 58 as illustrated in FIG. 6. At the ends of the contact carriers, there are spring metal contact elements 59, 60 and 61 in the form of a bridge (FIG. 7) having contact arms 62 and 63 arranged to engage the embedded circuit elements represented by the reference numerals 50 through 55.

The switching elements such as switch arms 62 and 63 move in arcuate slots 64, 65 and 66 best illustrated in FIG. 5. In the unactuated condition represented by FIG. 5, the switch element 59 bridges across two conducting strips and forms a normally closed switch to the cruise control circuit. Similarly, contact element 60 bridges across two of the conductor strips to provide a normally closed switch which forms the transmission clutch control contacts. A normally open switch is provided by the contact 61 in the circuit for lighting the lamp bulbs of the braking circuit.

As the brake pedal 13 is depressed, the actuator arm 25 is pivoted about the pin 37 and due to the compressive force of the spring 39, the actuator 40 presses firmly against the disk portion 46 so that the two more in unison. When, however, the actuator 40 strikes the second abutment 43, further movement of the actuator is prohibited, but the actuator arm 25 nevertheless can continue on to a greater arc because of the friction clutch provided at the interface between the disk portion 46 and the actuator 40. In the type of switch illustrated, this disconnects the cruise control and operates the solenoid which controls the torque converter. At the same time, electrical continuity is provided in the lighting circuit for the brake lamps to the contact 61.

Upon release of pressure on the brake pedal, the actuator 40 which is frictionally connected to the actuator arm 25 which is coupled to the brake pedal arm 14 returns to its abutting position against the first abutment 44 aided by the spring 45 thus self-readjusting itself every time the brake pedal 13 is released. This reactuates the cruise control and the solenoid in the transmission clutch control system.

It will be seen that the switch actuating mechanism cooperates with the housing and the spring-biased actuator to move the electrical contacts between open and closed positions and actuate their corresponding switches in response to deflection from their normal position. The actuating arm is capable of being deflected an amount greater than that required for actuating the switch to compensate for variations in travel of the brake pedal arm applied when the driver depresses the brake pedal.

It should be evident that various modifications can be made to the described embodiments without departing from the scope of the present invention.

I claim as my invention:

1. A switch assembly for a vehicle braking system comprising:

a housing, means on said housing arranged to frictionally engage a brake pedal arm pivot yoke in said vehicle, restraining means restraining pivotal movement of said housing, a switch actuator arm arranged to be coupled to the brake pedal arm on said vehicle, a switch actuator disposed within said housing, a friction clutch means interposed between said switch actuator arm and said switch actuator to permit first a driving and then a slippable connection therebetween whereby said switch actuator arm can pivot to a greater angular extent than said switch actuator, a plurality of electrical contacts carried by said switch actuator, circuit means engageable by said electrical contacts to make or break electrical contact therebetween, means within said housing limiting the pivotal movement of said electrical contacts to a predetermined arc, and terminal means connected to said circuit means and extending outside said housing.

2. A switch assembly according to claim 1 wherein said circuit means is integrally molded within a wall of said housing.

3. A switch assembly according to claim 1 wherein said friction clutch means includes a torsion spring to return said actuator to a predetermined starting position within said housing.

4. A switch assembly according to claim 1 in which said limiting means includes spaced first and second abutment means in said housing to limit the travel of said switch actuator within said housing.

5. A switch assembly according to claim 4 wherein said friction clutch includes a low friction disk coupled to said switch actuator arm, said disk bearing against said switch actuator, and spring means urging said disk and switch actuator together but permitting relative movement between the two when said switch actuator abuts said second abutment means.

6. A switch assembly according to claim 5 which includes spring means biasing said switch actuator against said first abutment means in the unactuated condition of the switch.

7. A switch assembly according to claim 1 which includes means defining arcuate slots formed in said housing and exposing said circuit means to engagement by said electrical contacts.

8. A switch assembly according to claim 7 wherein said electrical contacts are composed of a spring metal, and are in the form of a bridge, the ends of said contacts engaging said circuit means.

9. A switch assembly according to claim 8 wherein said circuit means consist of flat strips embedded in said housing.

10. A switch assembly according to claim 1 wherein said restraining means includes an integral projection extending outwardly from said housing.

* * * * *